US008202069B2

(12) United States Patent
Takagi et al.

(10) Patent No.: US 8,202,069 B2
(45) Date of Patent: Jun. 19, 2012

(54) ELECTRIC FUEL PUMP

(75) Inventors: Masatoshi Takagi, Takahama (JP); Motoya Ito, Hekinan (JP)

(73) Assignee: Denso Corporation, Kariya (JP)

( * ) Notice: Subject to any disclaimer, the term of this patent is extended or adjusted under 35 U.S.C. 154(b) by 889 days.

(21) Appl. No.: 11/896,404

(22) Filed: Aug. 31, 2007

(65) Prior Publication Data

US 2008/0063545 A1 Mar. 13, 2008

(30) Foreign Application Priority Data

Sep. 7, 2006 (JP) ..... 2006-242770
Sep. 7, 2006 (JP) ..... 2006-242800

(51) Int. Cl.
*F04B 35/04* (2006.01)

(52) U.S. Cl. ..... 417/423.14; 417/423.12; 417/410.1

(58) Field of Classification Search ..... 417/410.1, 417/423.7, 423.3, 423.14, 410.3, 423.12, 417/423.11; 310/239, 242, 88; 123/497, 123/495

See application file for complete search history.

(56) References Cited

U.S. PATENT DOCUMENTS 4,626,178 A * 12/1986 Terumoto ..... 417/366
4,845,393 A * 7/1989 Burgess et al. ..... 310/51
5,081,836 A 1/1992 Smith et al.
5,131,822 A 7/1992 Yamamoto et al.
5,141,410 A * 8/1992 Fujii ..... 417/423.7
5,520,547 A 5/1996 Hamaoka et al.
5,593,287 A * 1/1997 Sadakata et al. ..... 417/366
5,697,769 A * 12/1997 Kobman et al. ..... 417/410.1
5,723,932 A * 3/1998 Ito et al. ..... 310/248
5,762,481 A * 6/1998 Oi ..... 417/423.3
6,422,839 B1 * 7/2002 Brockner et al. ..... 417/423.7
6,478,613 B1 * 11/2002 Zoell et al. ..... 439/519
6,541,883 B2 * 4/2003 Uffelman ..... 310/71
6,800,982 B2 * 10/2004 Ebihara ..... 310/239
6,824,366 B2 * 11/2004 Nagasaka et al. ..... 417/423.1
6,832,901 B2 * 12/2004 Kuehn et al. ..... 417/423.1
6,890,160 B2 * 5/2005 Dokas ..... 417/423.3
7,014,432 B2 * 3/2006 Iwanari ..... 417/423.7
7,195,466 B2 * 3/2007 Kobayashi et al. ..... 417/423.7
2001/0022172 A1 * 9/2001 Moroto et al. ..... 123/497

(Continued)

FOREIGN PATENT DOCUMENTS

JP 55-129447 9/1980

(Continued)

OTHER PUBLICATIONS

Japanese Office Action dated Apr. 2, 2010, issued in corresponding Japanese Application No. 2006-242770, with English translation.

(Continued)

*Primary Examiner* — Charles Freay
*Assistant Examiner* — Alexander Comley
(74) *Attorney, Agent, or Firm* — Nixon & Vanderhye PC

(57) ABSTRACT

A fuel pump includes a case member defining a fuel passage, an inlet, and an outlet. A pump portion is provided in the fuel passage for pumping fuel from the inlet to the outlet. A motor portion is provided in the case member for driving the pump portion. A positive electrode terminal and a negative electrode terminal are provided for conducting electricity to the motor portion. A holder being insulative is provided inside the case member. The holder is mounted with the positive electrode terminal and the negative electrode terminal. The positive electrode terminal and the negative electrode terminal are resin-molded.

26 Claims, 15 Drawing Sheets

U.S. PATENT DOCUMENTS

| | | | | |
|---|---|---|---|---|
| 2003/0185693 | A1 | 10/2003 | Iwanari | |
| 2004/0253125 | A1* | 12/2004 | Kobayashi et al. | 417/410.1 |
| 2005/0074343 | A1* | 4/2005 | Naito | 417/423.3 |
| 2005/0095146 | A1* | 5/2005 | Oi et al. | 417/321 |
| 2005/0118044 | A1* | 6/2005 | Inoue et al. | 417/423.7 |
| 2005/0163636 | A1* | 7/2005 | Becker et al. | 417/423.3 |
| 2006/0013713 | A1* | 1/2006 | Honda et al. | 417/423.7 |
| 2007/0052310 | A1* | 3/2007 | Sakai et al. | 310/87 |
| 2007/0122300 | A1* | 5/2007 | Sakai et al. | 417/423.3 |

FOREIGN PATENT DOCUMENTS

| | | |
|---|---|---|
| JP | 3-83367 | 8/1991 |
| JP | 05-280486 | 10/1993 |
| JP | 06-205568 | 7/1994 |
| JP | 11-332204 | 11/1999 |
| JP | 2002-112500 | 4/2002 |
| JP | 2005-315088 | 11/2005 |

OTHER PUBLICATIONS

Japanese Office Action dated Mar. 30, 2010, issued in corresponding Japanese Application No. 2006-242833, with English translation.

Japanese Office Action dated Mar. 30, 2010, issued in corresponding Japanese Application No. 2006-242800, with English translation.

U.S. Appl. No. 11/896,407, filed Aug. 2007, Itoh et al.

Chinese Office Action dated Nov. 14, 2008, issued in counterpart Chinese Application No. 200710147283.2,with English translation.

Official Action dated Oct. 4, 2011, in copending U.S. Appl. No. 12/805,227 of Takagi, filed Jul. 20, 2010.

Final Official Action dated Feb. 17, 2012, issued in copending U.S. Appl. No. 12/805,227 of Takagi, filed Jul. 20, 2010.

* cited by examiner

ELECTRIC FUEL PUMP

CROSS REFERENCE TO RELATED APPLICATIONS

This application is based on and incorporates herein by reference Japanese Patent Applications No. 2006-242770 filed on Sep. 7, 2006 and No. 2006-242800 filed on Sep. 7, 2006.

This application is related to co-pending commonly assigned, U.S. patent application Ser. No. 11/896,407 filed on Aug. 31, 2007, and claiming priority to the following Japanese Patent Application:

No. 2006-242833 filed on Sep. 7, 2006.

FIELD OF THE INVENTION

The present invention relates to an electric fuel pump. The present invention further relates to a method for manufacturing the electric fuel pump.

BACKGROUND OF THE INVENTION

For example, U.S. Pat. No. 5,520,547 (JP-A-7-91343), and U.S. Pat. No. 6,478,613 (JP-T-2002-544425) disclose fuel pumps each having a case member accommodating a pump portion and a motor portion. The pump portion is driven by an armature of the motor portion.

As disclosed in U.S. Pat. No. 5,520,547, a fuel pump includes a discharge-side cover and case members. The cover and the case members respectively have an outlet and an inlet, and define fuel passages therein. The discharge-side cover includes a bearing holder being insulative and mounted with positive and negative electrode terminals.

The motor portion is supplied with electricity from an external power source via the positive and negative electrode terminals.

Here, a gasoline-alternate fuel, such as high density alcohol petroleum fuel mixture, bio-ethanol, ethanol 100% fuel, and the like, is in great demand. The gasoline-alternate fuel contains a component of high electric conductivity therein. When conventional pumps for gasoline fuel are to be applied to a fuel pump for a gasoline-alternate fuel, as it is, a problem described below is caused.

Specifically, with the fuel pump described in U.S. Pat. No. 5,520,547, the load bearing portions are provided on both the terminals, and are exposed to the fuel passage. In this structure, the terminals are exposed entirely to the gasoline-alternate fuel containing a component of high conductivity, and consequently, the terminals cause electrochemical corrosion due to exposure to gasoline-alternate fuel.

Such an electric corrosion is apt to occur as the distance between both the terminals becomes short. However, when both the terminals are arranged simply further distant from each other, the fuel pump becomes large in size.

SUMMARY OF THE INVENTION

In view of the foregoing and other problems, it is an object of the invention to provide a fuel pump capable of pumping electrically conductive fuel and suppressing electrochemical corrosion of a terminal therein. It is another object of the present invention to produce a method for manufacturing the fuel pump.

According to one aspect of the present invention, a fuel pump comprises a discharge-side cover defining an outlet. The fuel pump further comprises a case member connected with the discharge-side cover, and defining a fuel passage communicating with the outlet, the case member defining an inlet. The fuel pump further comprises a pump portion provided in the fuel passage for pumping fuel from the inlet to the outlet. The fuel pump further comprises a motor portion provided in the case member for driving the pump portion. The fuel pump further comprises a positive electrode terminal and a negative electrode terminal each extending from an inside of the discharge-side cover for conducting electricity to the motor portion. The fuel pump further comprises a bearing holder being insulative and supporting a rotation axis of the motor portion. The fuel pump further comprises a terminal support member being insulative and provided between the discharge-side cover and the bearing holder for supporting the positive electrode terminal and the negative electrode terminal. One of the terminal support member and the discharge-side cover has a projection extending from a portion between the positive electrode terminal and the negative electrode terminal. An other of the terminal support member and the discharge-side cover has a recess opposed to the projection.

According to another aspect of the present invention, a fuel pump comprises a case member defining a fuel passage, an inlet, and an outlet. The fuel pump further comprises a pump portion provided in the fuel passage for pumping fuel from the inlet to the outlet. The fuel pump further comprises a motor portion provided in the case member for driving the pump portion. The fuel pump further comprises a positive electrode terminal and a negative electrode terminal for conducting electricity to the motor portion. The fuel pump further comprises a holder being insulative, and provided inside the case member. The holder is mounted with the positive electrode terminal and the negative electrode terminal. The positive electrode terminal and the negative electrode terminal are resin-molded.

According to another aspect of the present invention, a method for manufacturing a fuel pump, the fuel pump comprises a case member defining a fuel passage. The fuel pump further comprises an inlet, and an outlet. The fuel pump further comprises a pump portion provided in the fuel passage for pumping fuel from the inlet to the outlet. The fuel pump further comprises a motor portion provided in the case member for driving the pump portion. The fuel pump further comprises a positive electrode terminal and a negative electrode terminal for conducting electricity to the motor portion. The fuel pump further comprises a holder being insulative and provided inside the case member, and mounted with both the positive electrode terminal and the negative electrode terminal. The method comprises mounting of the positive electrode terminal and the negative electrode terminal to the holder. The method further comprises resin-molding of the positive electrode terminal and the negative electrode terminal, which are mounted to the holder to form a molded body including the holder and a molded portion. The method further comprises connecting of the molded body to the case member.

According to another aspect of the present invention, a method for manufacturing a fuel pump, the method comprises mounting a positive electrode terminal and a negative electrode terminal to a holder being insulative. The method further comprises resin-molding of the positive electrode terminal and the negative electrode terminal together with the holder to form a molded body. The method further comprises electrically connecting of the molded body to an armature and a commutator via brushes. The method further comprises providing of a pump portion in a case member defining therein a fuel passage to be connected with a rotation axis of the armature.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

A fuel pump according to an embodiment will be described below with reference to FIGS. 1 to 10C.

Figure 1:
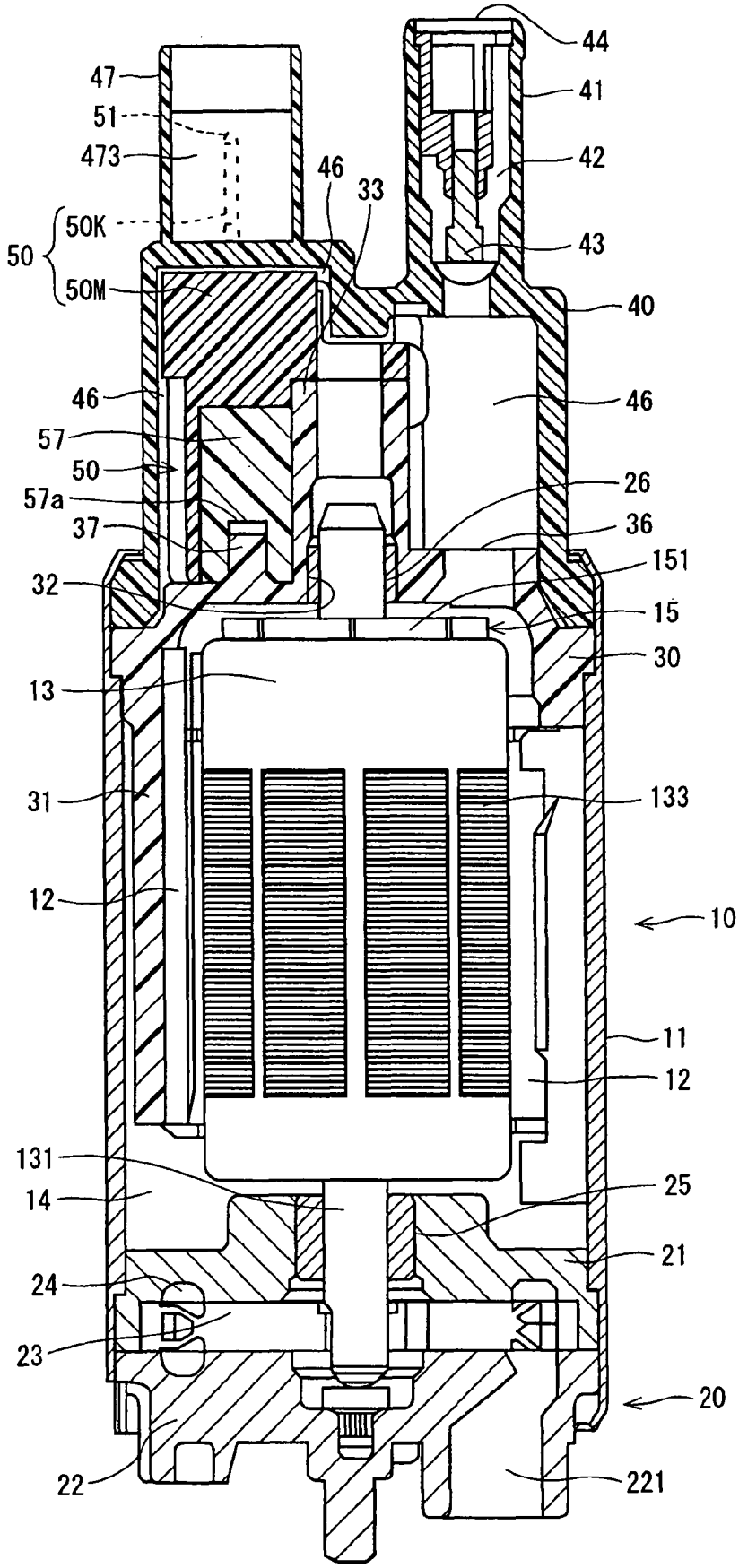
FIG. 1 is a cross sectional view showing a fuel pump according to a first embodiment.

A fuel pump shown in FIG. 1 is an in-tank type pump mounted in a fuel tank of, for example, a vehicle. Accordingly, the fuel pump is entirely submerged in fuel. The fuel pump supplies fuel from a fuel tank to an engine. The fuel, which is pumped using the fuel pump, is one, such as high density alcohol petroleum fuel mixture, bio-ethanol, ethanol 100% fuel, containing a component of high electric conductivity.

As follows, a construction of the fuel pump will be described with reference to FIG. 1. The fuel pump includes a motor portion 10 and a pump portion 20 driven by the motor portion 10 to raise a fuel as drawn in pressure.

The motor portion 10 includes a direct current motor with a brush. The fuel pump includes a substantially cylindrical-shaped housing 11. The housing 11 has an inner periphery, to which permanent magnets 12 are annually provided along the circumferential direction thereof. An armature 13 is arranged on the inner periphery of the annular permanent magnet 12 to be concentric with the annular permanent magnet 12. The armature 13 is accommodated rotatably in the inner space of the housing 11.

The armature 13 includes a core 133 and a coil (not shown) wound around the outer periphery of the core 133. A commutator 15 is disk-shaped, and mounted on the opposite side of the pump portion 20 with respect to the armature 13. The commutator 15 includes multiple segments 151 arranged along a rotative direction thereof. The segments 151 are formed of, for example, carbon, and are electrically insulated from one another via air gaps and an insulative resin material.

The commutator 15 is in contact with brushes 61, 62 (see FIGS. 2A, 2B), which are biased by brush springs 71, 72 serving as resilient members. The brush spring 71 and the brush 61 are present on a positive electrode side, and the brush spring 72 and the brush 62 are present on a negative electrode side. Depiction of the brush springs 71, 72 and the brushes 61, 62 is omitted in FIG. 1.

The pump portion 20 includes an impeller 23 arranged between a casing body 21 and a pump cover 22, and the like. The casing body 21 and the pump cover 22 define a substantially C-shaped pump flow passage 24. The casing body 21 and the pump cover 22 therebetween rotatably accommodate the impeller 23.

The casing body 21 is fixed by being press-fitted to one end side of the housing 11 with respect to the axial direction thereof. A bearing 25 is provided centrally of the casing body 21. The pump cover 22 is fixed to one end of the housing 11 by crimping or the like in a state where being connected with the casing body 21. One end of a shaft 131 (rotation axis) of the armature 13 is radially supported rotatably by the bearing 25. The other end of the shaft 131 is radially supported rotatably by a bearing 26. The shaft 131 serves as a rotation axis.

The pump cover 22 has an inlet 221 through which a fuel is drawn. The impeller 23 has a peripheral edge defining a vane groove therein. The impeller 23 rotates in the pump flow passage 24, thereby drawing fuel from an unillustrated fuel tank into the pump flow passage 24 through the inlet 221. The fuel drawn into the pump flow passage 24 is raised in pressure by rotation of the impeller 23, and discharged to a space 14 of the motor portion 10.

A bearing holder 30 and a discharge-side cover 40 are mounted at the other end of the housing 11, that is, on the opposite side of the pump cover 22 with respect to the casing body 21. The bearing holder 30 is interposed and fixed between the discharge-side cover 40 and the housing 11. The discharge-side cover 40 is fixed to the housing 11 by crimping.

The housing 11, the pump cover 22, and the discharge-side cover 40 construct a case member.

The discharge-side cover 40 includes a fuel discharge portion 41. The fuel discharge portion 41 accommodates a check valve 43 for opening and closing a fuel passage 42 in the fuel discharge portion 41. When the interior of the fuel pump is filled with fuel, the check valve 43 opens the fuel passage 42. The fuel is raised in pressure by the pump portion 20, and supplied from an outlet 44 to the outside of the fuel pump through an unillustrated piping connected to the outlet 44 of the fuel discharge portion 41.

Figure 2A:
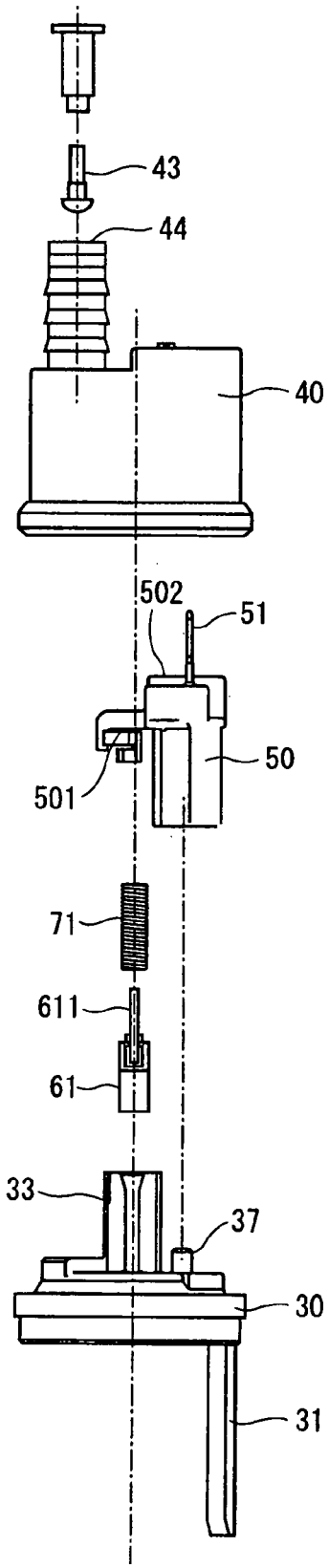
FIGS. 2A, 2B compose a dihedral view, FIG. 2A being an exploded front view showing a discharge-side cover and components to be received in the discharge-side cover of the fuel pump, and FIG. 2B being an exploded side view showing the discharge-side cover and the components.
Figure 2B:
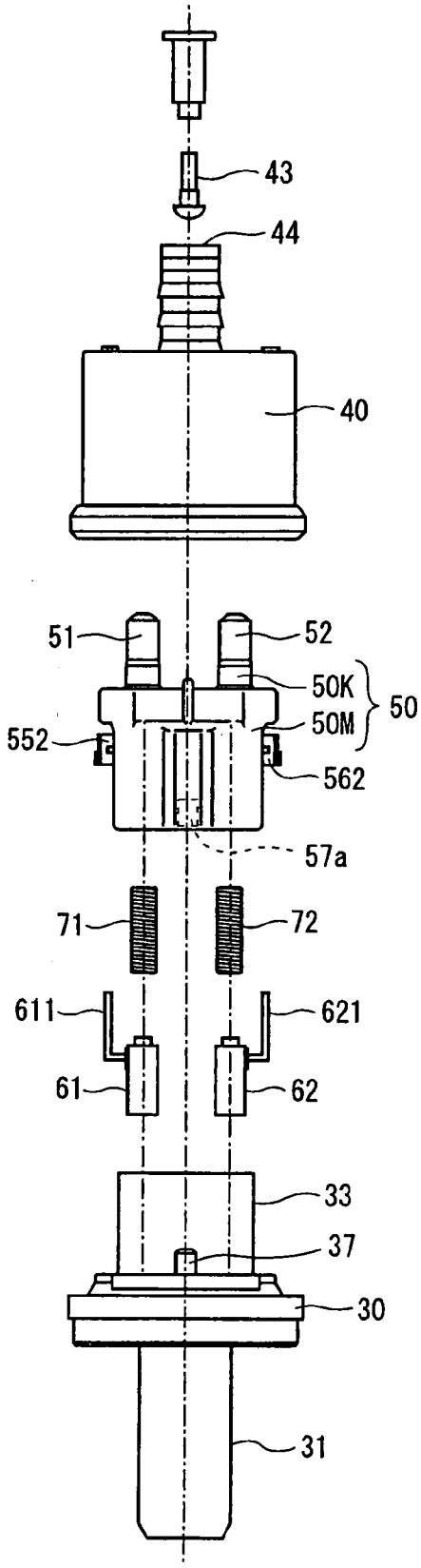

As shown in FIGS. 2A, 2B, a molded body 50 described later is interposed and fixed between the bearing holder 30 and the discharge-side cover 40. Brushes 61, 62 are assembled to the bearing holder 30 to be axially movable. Brush springs 71, 72 bias downward the upper end surfaces of the brushes 61, 62 in FIGS. 2A, 2B. The upper end surfaces of the brush springs 71, 72 abut against a load bearing portion 501 of the molded body 50 in FIGS. 2A, 2B.

Subsequently, the structure of the molded body 50 will be described with reference to FIGS. 3 to 7D. The molded body 50 is formed to be in a state shown in FIGS. 7A to 7D by molding an assembled body 50K shown in FIGS. 5A to 5C. First, the structure of the assembled body 50K will be described below.

Figure 3:
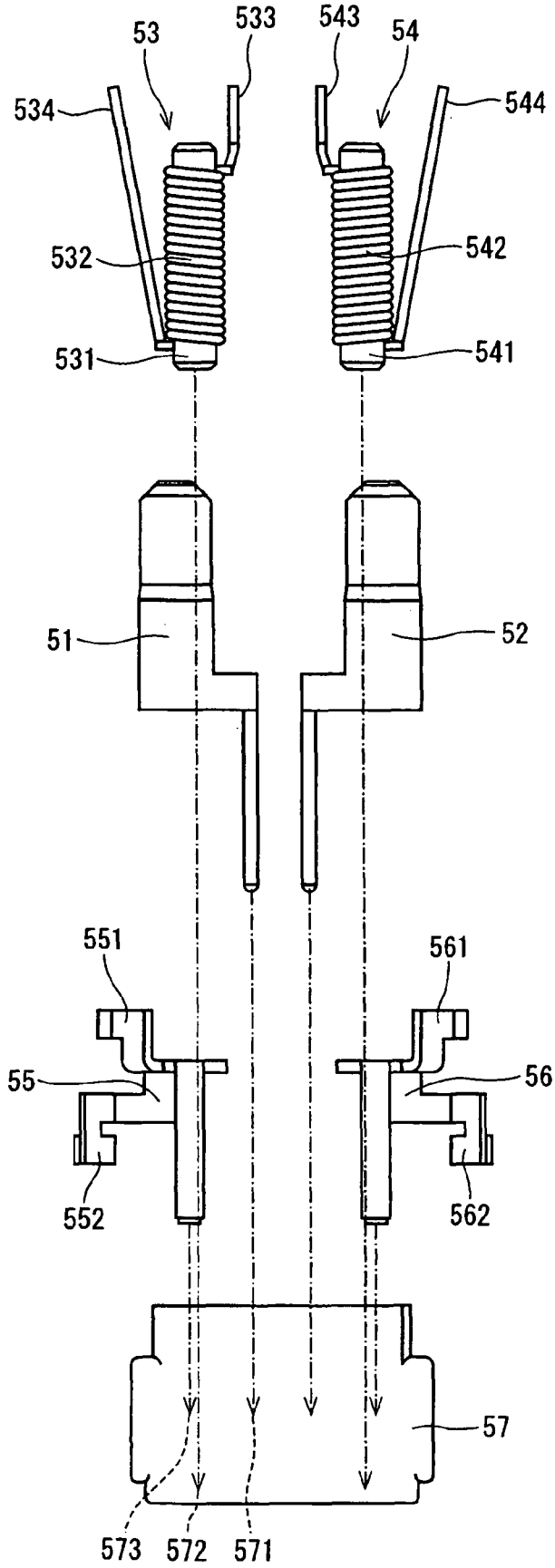
FIG. 3 is an exploded view showing an assembled body of the components shown in FIGS. 2A, 2B.

As shown in FIG. 3, the assembled body 50K is constructed by mounting external connection terminals 51, 52, choke coils 53, 54, and brush terminals 55, 56 to a holder 57 of an insulative body. The external connection terminal 51, the choke coil 53, and the brush terminal 55 are present on a positive electrode side, and the external connection terminal 52, the choke coil 54, and the brush terminal 56 are present on a negative electrode side.

The external connection terminals 51, 52, the choke coils 53, 54, the brush terminals 55, 56, and the brushes 61, 62, are electrically connected with each other. Electricity is supplied from an external power source to the fuel pump through the external connection terminals 51, 52. The external connection terminals 51, 52 are connected with unillustrated other external terminals. Electricity flows through the choke coils 53, 54, the brush terminals 55, 56, and the brushes 61, 62 in this order, so that the electricity is supplied to a coil (not shown) of the armature 13 through the brushes 61, 62 and the commutator 15.

The choke coils 53, 54 serve to decrease electric noise such as high frequency component caused when the brushes 61, 62 sequentially slide on the respective segments 151 of the commutator 15. In addition, the choke coils 53, 54 are constructed of coils 532, 542 and cores 531, 541. The coils 532, 542 are formed by winding wires around the cores 531, 541 each being columnar-shaped. The core 531 and the coil 532 are present on a positive electrode side. The core 541 and the coil 542 are present on a negative electrode side.

Figure 4A:
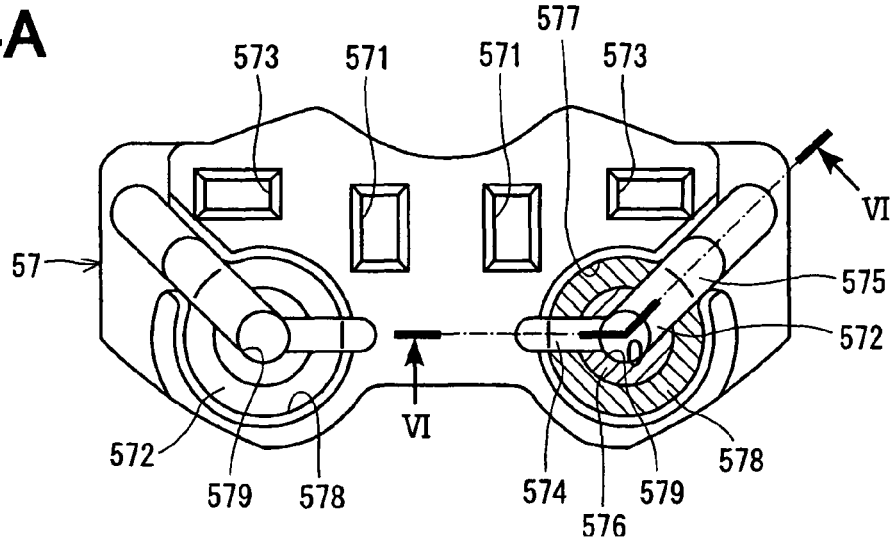
FIGS. 4A, 4B, 4C compose a trihedral view, FIG. 4A being a plan view, FIG. 4B being a front view, and FIG. 4C being a bottom view, each showing the assembled body shown in FIG. 3.
Figure 4B:
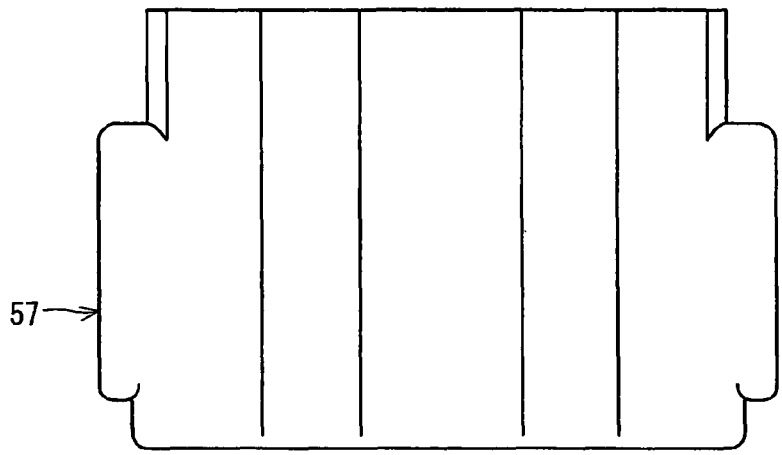
Figure 4C:
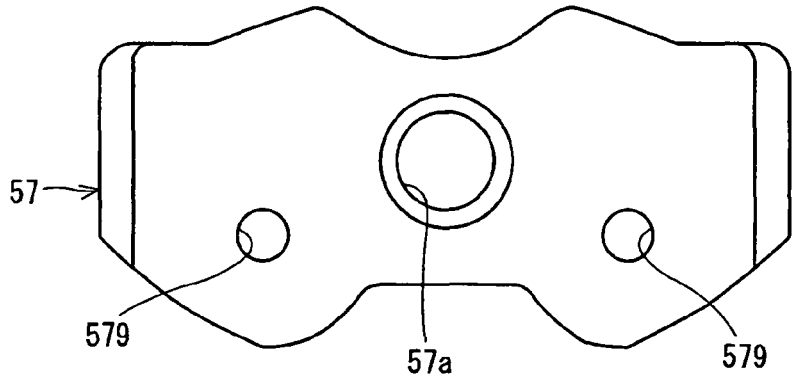
Figure 5C:
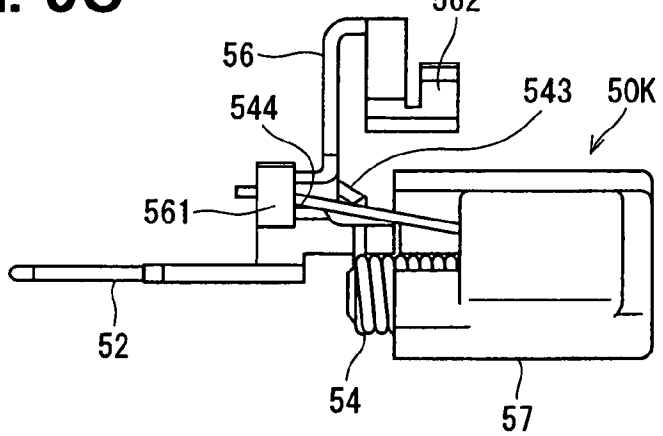
FIGS. 5A, 5B, 5C compose a trihedral view, FIG. 5A being a plan view showing the assembled body shown in FIG. 3, FIG. 5B being a front view, and FIG. 5C being a side view.
Figure 5A:
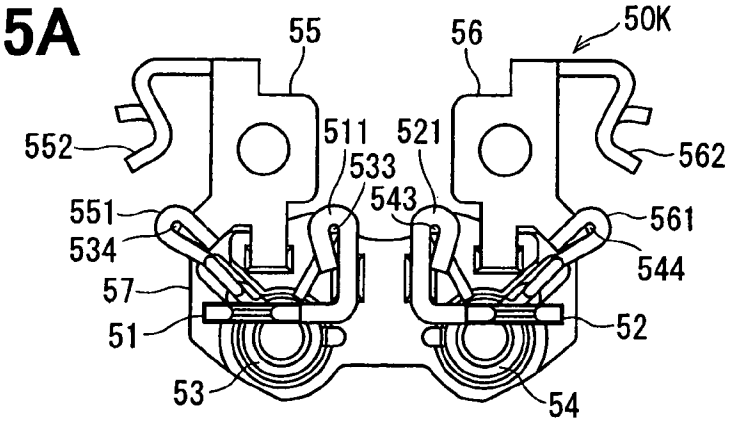
Figure 5B:
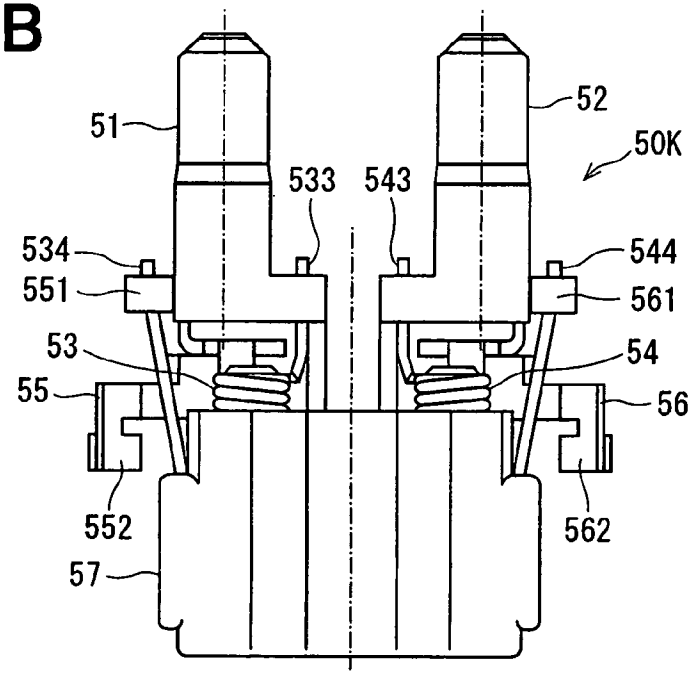

As shown in FIGS. 4A to 4C, the holder 57 has the upper surface side defining insertion holes 571, 572, 573. As shown in FIGS. 5A to 5C, the external connection terminals 51, 52 are respectively inserted into the insertion holes 571. The choke coils 53, 54 are respectively inserted into the insertion holes 572. The brush terminals 55, 56 are respectively inserted into the insertion hole 573.

As shown in FIGS. 2A, 2B, 3, 5A to 5C, connecting portions 511, 521 of the external connection terminals 51, 52 and connecting portions 533, 543 of the choke coils 53, 54 are respectively connected together by thermal crimping or fusing. Connecting portions 534, 544 of the coils 532, 542 and connecting portions 551, 561 of the brush terminals 55, 56 are connected together by thermal crimping or fusing. In addition, connecting portions 552, 562 of the brush terminals 55, 56 and pigtails (strand wire) 611, 621 connected to the brushes 61, 62 are connected together by thermal crimping or fusing.

Subsequently, a construction of the choke coils 53, 54 mounted to the insertion holes 572 of the holder 57 will be described in detail with reference to FIGS. 4A and 6. Only a structure of the insertion hole 572 for the choke coil 54 on the negative electrode side is illustrated in FIG. 6, and a structure of the insertion hole 572 for the choke coil 53 on the positive electrode side is also substantially the same as that on the negative electrode side, and so a description therefore is omitted.

Figure 6:
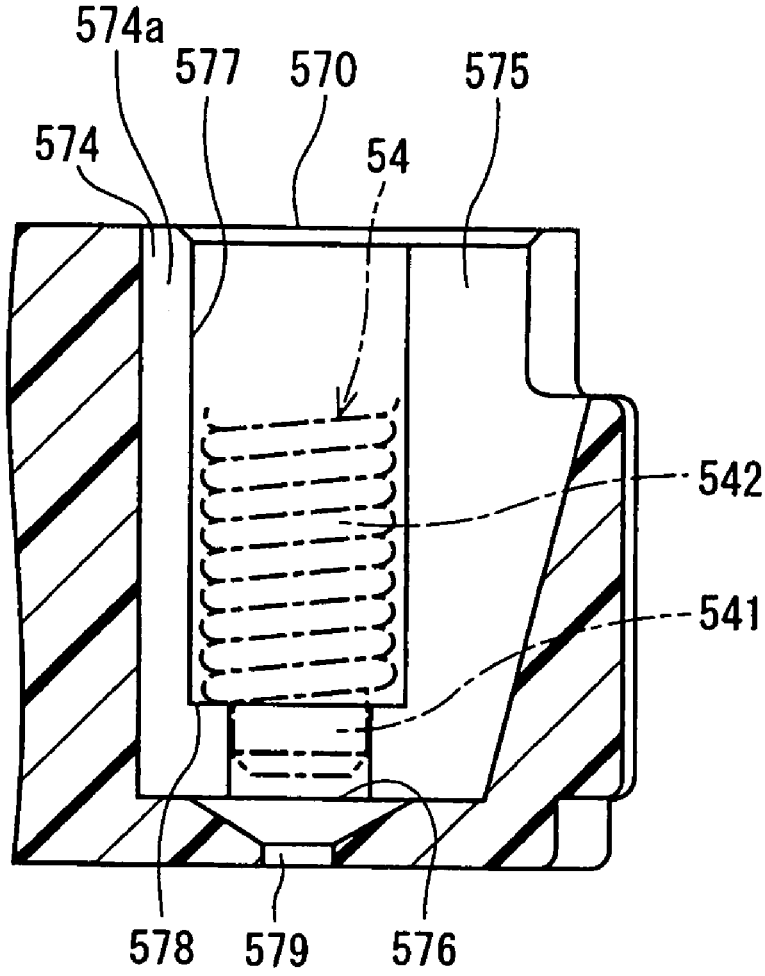
FIG. 6 is a cross sectional view taken along the line VI-O-VI in FIG. 4A.

As shown in FIG. 6, an inner peripheral surface 574*a* of the insertion hole 572 and the coil 542 of the choke coil 54 therebetween define a clearance. The resin is press-charged into the clearance when the assembled body 50K is molded of a resin.

The coil 542 is partially inserted in the insertion hole 572. The connecting portion 543 is inserted in an insertion groove 574. The connecting portion 544 is inserted in an insertion groove 575. The clearance between the inner surfaces, which respectively define the insertion grooves 574, 575, and the coil 542 is also press-charged with the resin as described above.

Each of lower ends of the insertion grooves 574, 575 defines a core stopper 576, which latches an insertion-side end surface of the core 541 to restrict axial movements of the core 541. The core stopper 576 is located in the hatched region indicated by the reference numeral 576 in FIG. 4A. The core stopper 576 is capable of restricting the core 541 from downwardly moving in FIG. 6 when the resin is press-charged into the clearance around the coil 542.

A lower end of an inner peripheral surface 577 of the insertion hole 572 defines a coil stopper 578, which latches an insertion-side end surface of the coil 542 to restrict axial movements of the of the coil 542. The coil stopper 578 is located in the hatched region indicated by the reference numeral 578 in FIG. 4A. The coil stopper 578 is capable of restricting the coil 542 from downwardly moving in FIG. 6 when the resin is press-charged into the clearance around the coil 542.

The coil 542 is wound around the core 541 in a compacted state, so that the core 541 is clamped by the coil 542. Accordingly, the coil 542 is restricted from being moved downward in FIG. 3 from the core 541 by its own weight. When the choke coil 54 is mounted to the insertion hole 572, simple insertion of the choke coil 54 into the insertion hole 572 may cause only the coil 542 to abut against the coil stopper 578 but the core 541 does not abut against the core stopper 576. Therefore, the choke coil 54 is inserted into the insertion hole 572, thereafter, only the core 541 is pushed downward in FIG. 6 against the core stopper 576. Thus, the choke coil 54 is assembled such that the coil 542 and the core 541 are respectively abutted against the coil stopper 578 and the core stopper 576 before being molded with the resin.

The holder 57 has insertion openings 570, through which the choke coils 53, 54 are inserted into the insertion holes 572, and through-holes 579, which are located on the opposite sides to the insertion openings 570. The through-holes 579 communicate the inside of the insertion hole 572 with the outside of the insertion hole 572.

In press-charging of resin into the insertion holes 572 to resin-mold the choke coils 53, 54, the resin is press-charged from the insertion openings 570 into the insertion holes 572. The resin being press-charged flows outside the insertion holes 572 through the through-holes 579. Therefore, the resin can be enhanced in flowability between the inner peripheral surfaces 577 of the insertion holes 572 and the coils 532, 542, as compared with a structure where the insertion holes 572 are in the form of a blind hole without the through-holes 579.

Thus, it is possible to decrease failure in filling of the resin into the clearances between the inner peripheral surfaces 577 of the insertion holes 572 and the coils 532, 542.

Subsequently, referring to FIG. 7A to 7D, a detailed structure of the molded body 50, which is formed by resin-molding the assembled body 50K, will be described.

Figure 7C:
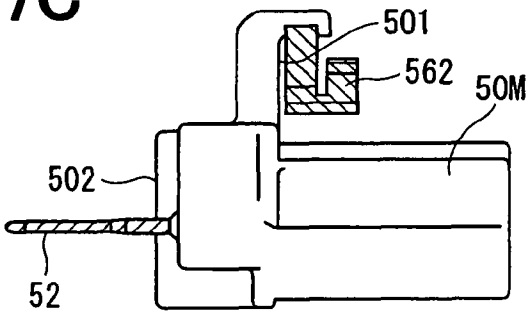
FIGS. 7A to 7C compose a trihedral view showing a molded body including the assembled body.
Figure 7D:
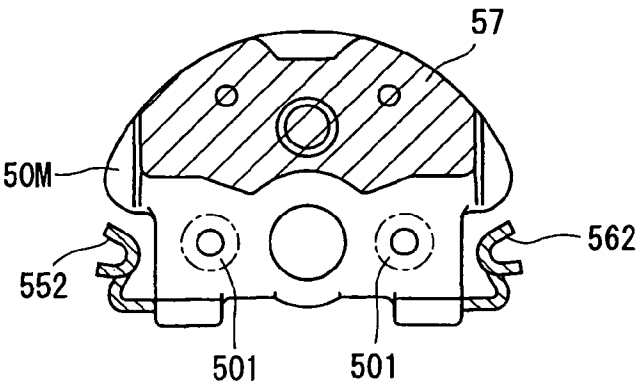
FIG. 7D is a view when being viewed from an arrow VIID in FIG. 7B.
Figure 7A:
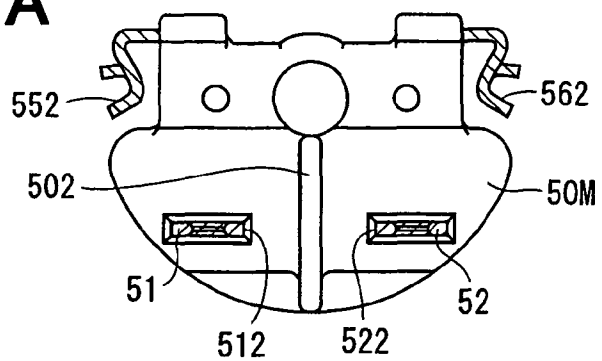

The molded body 50 is constructed of a molded portion 50M and the assembled body 50K. A portion of the assembled body 50K other than a portion described below is covered with the molded portion 50M. The bottom surface of the holder 57 being a hatched portion in FIG. 7D is exposed from the bottom surface of the molded portion 50M. The external connection terminals 51, 52 being hatched portions in FIGS. 7A to 7C extend from the upper surface of the molded portion 50M. The connecting portions 552, 562 of the brush terminals 55, 56 being hatched portions in FIGS. 7A to 7D extend from sides of the molded portion 50M.

In this manner, the external connection terminal 51 on the positive electrode side and the external connection terminal 52 on the negative electrode side are resin-molded in a state where being mounted to the holder 57 of the insulative body. The external connection terminals 51, 52, the choke coils 53, 54, and the brush terminals 55, 56 can be decreased in area exposed to the fuel passage 46. Accordingly, it is possible to suppress electric corrosion of both the external connection terminals 51, 52, and to decrease a fear of failure in conduction and breakage of both the external connection terminals 51, 52.

In addition, the holder 57 and the molded portion 50M in the embodiment serve as a "terminal support member".

Subsequently, a structure of the molded body 50 being fixed to the bearing holder 30 and the discharge-side cover 40, will be described in detail with reference to FIGS. 8A to 9D.

As shown in FIGS. 8A to 8D, the bearing holder 30 has a projection 37 extending toward the molded body 50. On the other hand, the bottom surface of the holder 57, which is exposed from the molded portion 50M, has a recess 57*a*, into which the projection 37 is to be press-fitted. As shown in FIGS. 9A to 9D, the projection 37 is press-fitted into the recess 57*a*, so that the molded body 50 is fixed to the bearing holder 30.

Figure 9C:
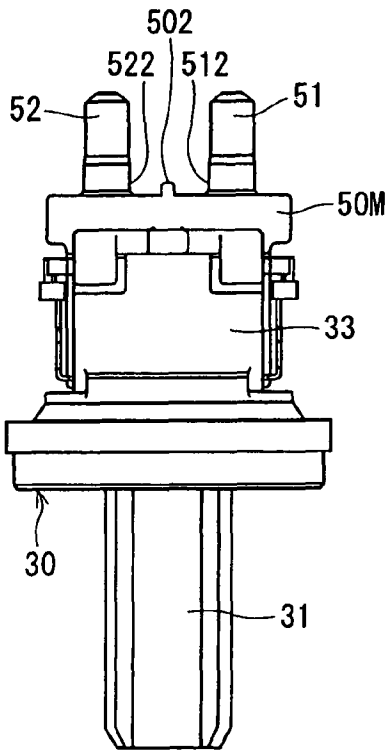
FIGS. 9A to 9D compose a tetrahedral view, FIG. 9A being a front view, FIG. 9B being a side view, FIG. 9C being a rear view, and FIG. 9D being a plan view, each showing a state in which the molded body shown in FIGS. 7A to 7D is mounted to the bearing holder shown in FIGS. 2A, 2B.
Figure 9D:
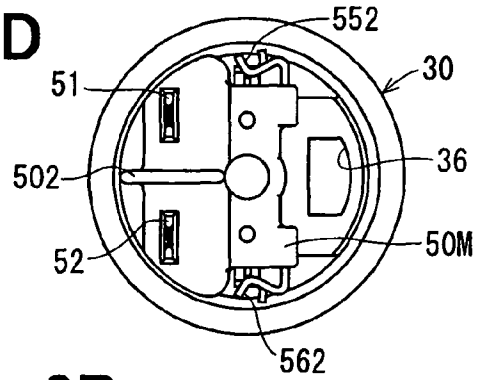
Figure 9B:
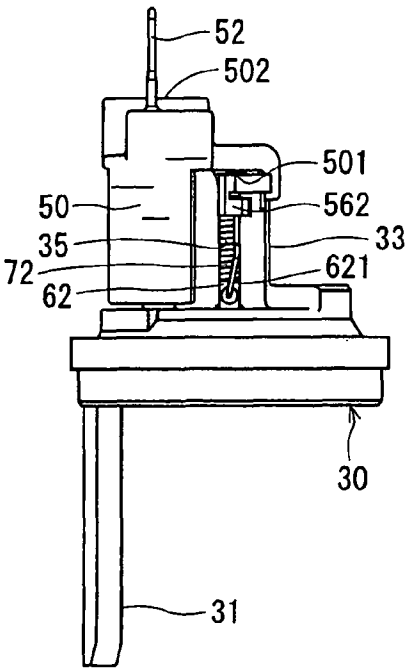
Figure 9A:
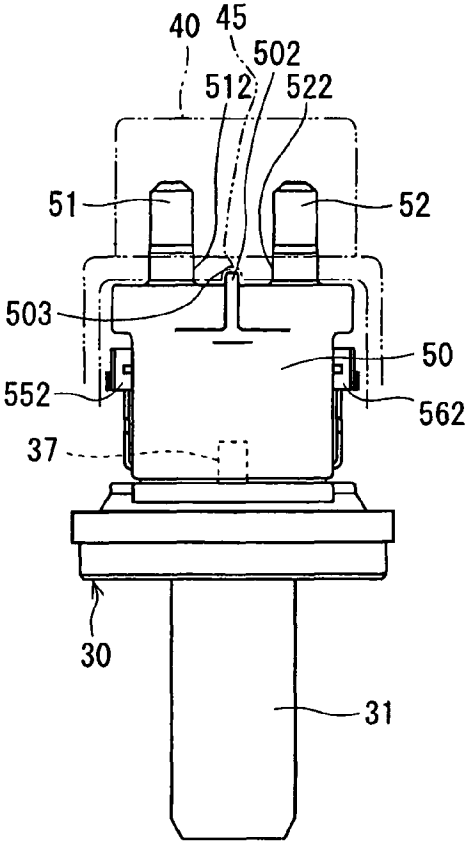

The molded body 50 is press-fitted and fixed to the bearing holder 30, so that the molded body 50 is temporarily mounted to the bearing holder 30, until the discharge-side cover 40 surrounds the bearing holder 30 from the upward in FIG. 9A, as depicted by the two-dot chain lines in FIG. 9A, and crimped to the housing 11. The molded body 50 is interposed and fixed between the bearing holder 30 and the discharge-side cover 40, and the discharge-side cover 40 is crimped and fixed to the housing 11.

The bearing holder 30 includes a latch portion 31 axially extending to latch the circumferential periphery of the permanent magnet 12. The bearing holder 30 has a bearing holding hole 32, into which the bearing 26 is press-fitted and held.

The bearing holder 30 includes a brush holding portion 33 extending upward in FIG. 9A. The brush holding portion 33 has a brush holding hole 34 (FIG. 8D) extending vertically in FIG. 9A. The brushes 61, 62 and the brush springs 71, 72 are held in the brush holding hole 34 such that the brushes 61, 62 are vertically movable in the brush holding hole 34. The brush holding portions 33 have side surfaces respectively defining notched holes 35, in which the pigtails 611, 621 are arranged. The bearing holder 30 has a through-hole 36, which defines a fuel passage. Fuel flows from the housing 11 into the discharge-side cover 40 through the through-hole 36.

Figure 7B:
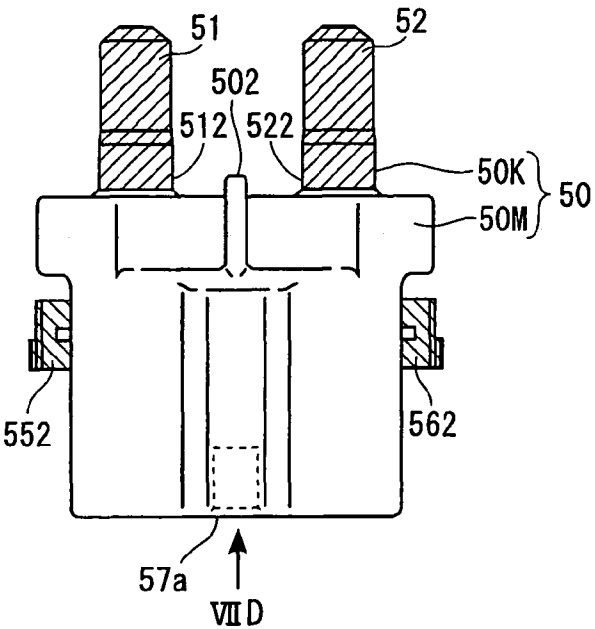
Figure 8D:
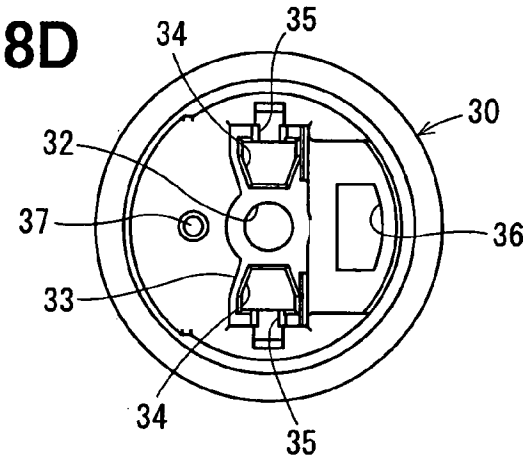
FIGS. 8A to 8D compose a tetrahedral view, FIG. 8A being a front view, FIG. 8B being a side view, FIG. 8C being a rear view, and FIG. 8D being a plan view, each showing a bearing holder shown in FIGS. 2A, 2B.
Figure 8B:
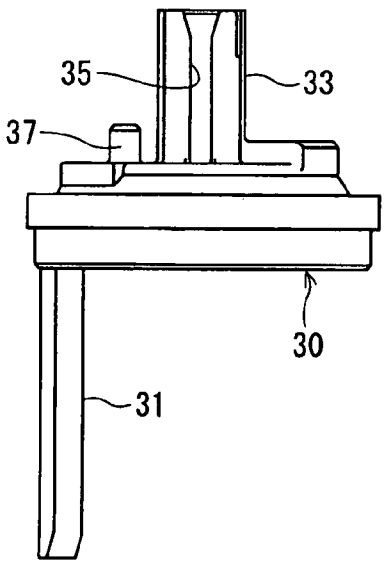
Figure 8C:
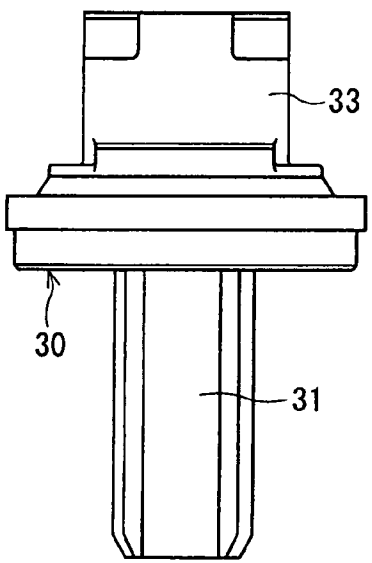
Figure 8A:
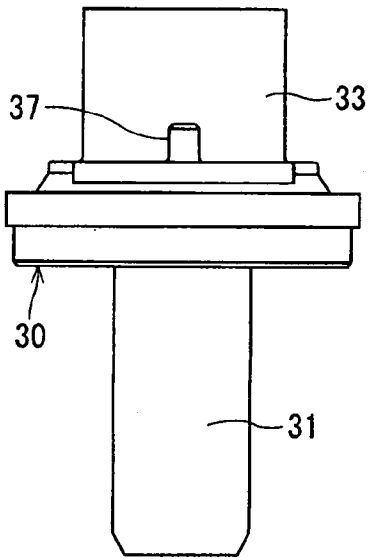

As shown in FIGS. 7C to 7D and 9A to 9D, the upper surface portion of the molded portion 50M of the molded body 50 has a projection 502. The projection 502 extends from a portion between the external connection terminal (positive electrode terminal) 51 on the positive electrode side and the external connection terminal (negative electrode terminal) 52 on the negative electrode side. The projection 502 is shaped to extend along the upper surface of the molded portion 50M in a manner to partition both the external connection terminals 51, 52 from one another, as shown in FIG. 9D. As shown in FIG. 7B, the external connection terminal 51 has a root portion 512 on the positive electrode side. The external connection terminal 52 has a root portion 522 on the negative electrode side. The projection 502 separates the root portion 512 of the positive electrode terminal 51 from the root portion 522 of the negative electrode terminal 52.

The inner surface of the discharge-side cover 40 has a portion, which is opposed to the projection 502 and defining a recess 45. The recess 45 is shaped along a convex surface of the projection 502. The recess 45 extends in a manner to partition both the external connection terminals 51, 52 from each other, similarly to the projection 502.

The distance between a projection surface of the projection 502 and a recess surface of the recess 45 is substantially constant. In this structure, the upper surface of the molded portion 50M and the inner surface of the discharge-side cover 40 therebetween define a clearance 503 (see FIG. 9A), and the clearance 503 is substantially constant between the projection 502 and the recess 45.

In addition, referring to FIG. 1, the outer surface of the discharge-side cover 40 defines a connector housing 47 to accommodate therein the external connection terminal 51 on the positive electrode side and the external connection terminal 52 on the negative electrode side.

Figure 10D:
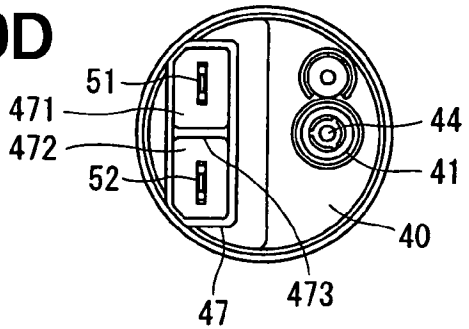
FIGS. 10A to 10D compose a tetrahedral view, FIG. 10A being a front view, FIG. 10B being a side view, FIG. 10C being a rear view, and FIG. 10D being a plan view, each showing a state in which the discharge-side cover is mounted to the assembled body.
Figure 10B:
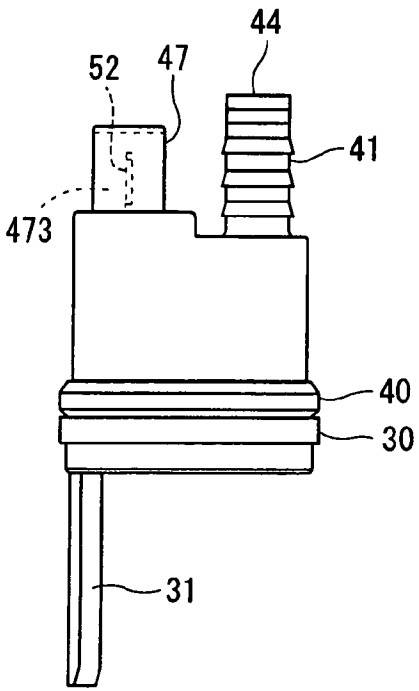
Figure 10C:
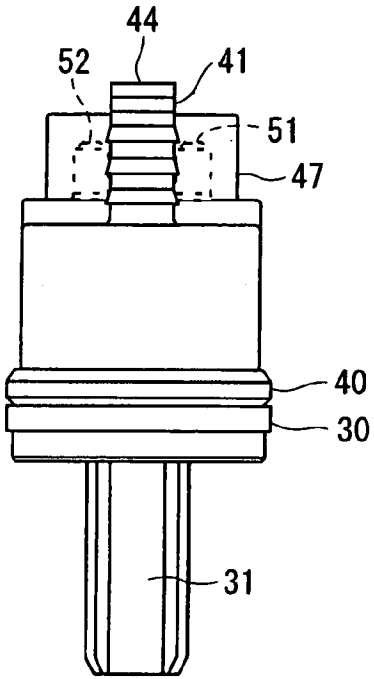
Figure 10A:
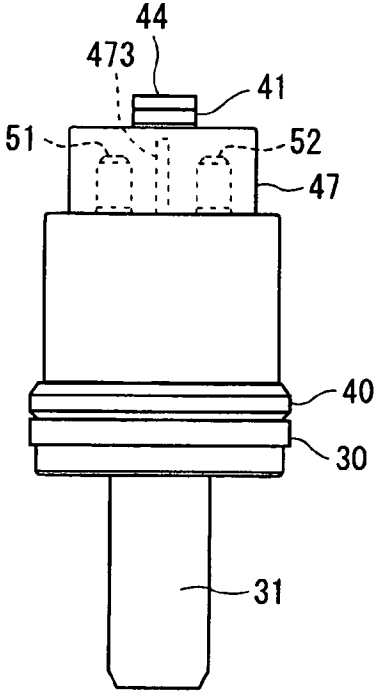
Figure 11:
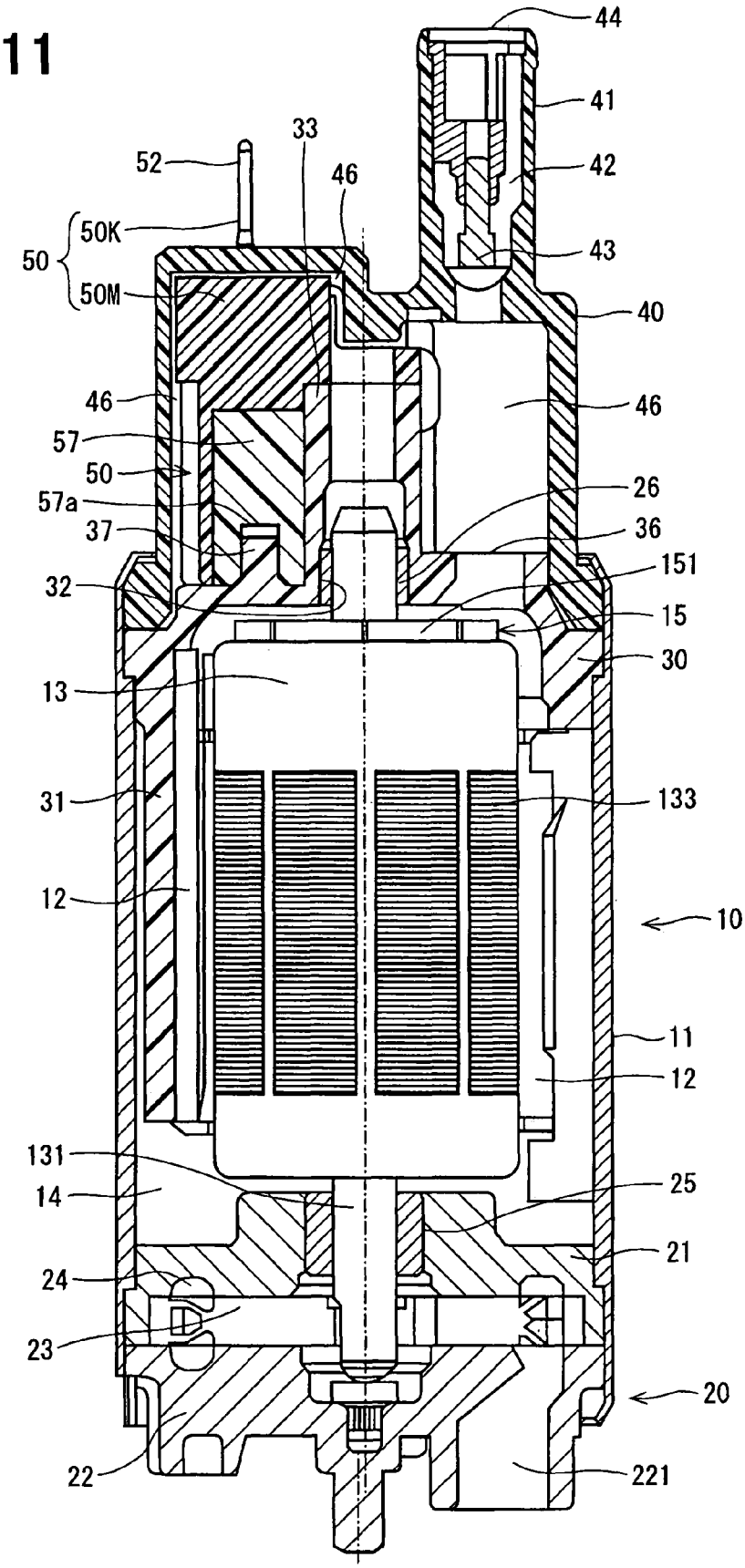
FIG. 11 is a cross sectional view showing a fuel pump according to a second embodiment.

As shown in FIG. 10D, the connector housing 47 has a partition 473. The partition 473 separates the internal space of the connector housing 47 into a space 471, which accommodates the external connection terminal 51 on the positive electrode side, and a space 472, partition 473 the external connection terminal 52 on the negative electrode side. In other words, the partition 473 is shaped to extend in a manner to partition both the external connection terminals 51, 52 from one another.

Both the external connection terminals 51, 52 are connected with an external terminal (not shown) via a connector device. That is, the connector device such as a connector housing (not shown) provided on the external terminal is fitted to the connector housing 47, so that the external terminal are electrically connected with the external connection terminals 51, 52.

Fuel may enter from the fuel tank into both the connector housings 47. In this state, both the external connection terminals 51, 52 are in contact with fuel in the connector housing 47.

In this structure, the upper surface of the molded portion 50M and the inner surface of the discharge-side cover 40 therebetween define a clearance 503 (see FIG. 9A). The clearance 503 is shaped so as to meander between the projection 502 and the recess 45 in FIG. 9A. Accordingly, a creeping distance between the root portion 512 of the external connection terminal 51 on the positive electrode side and the root portion 512 of the external connection terminal 52 on the negative electrode side becomes large, as compared with a structure, which does not have the projection 502 and the recess 45. Therefore, it is possible to restrict fuel present in the clearance 503 from causing electric corrosion of both the terminals 51, 52.

As shown in FIGS. 10A to 10D, the external connection terminals 51, 52 are extended and exposed from the upper surface of the discharge-side cover 40. The unillustrated external terminal is connected to the external connection terminals 51, 52 in this state. In this connection, the external terminal may be press-fitted to and connected to the external connection terminals 51, 52, or a connector housing may be provided on the upper surface of the discharge-side cover 40 and connected to a connector housing of the external terminal by connector-fitting.

Subsequently, a procedure for mounting the assembled body shown in FIGS. 10A to 10D will be described.

First, as shown in FIG. 3, the external connection terminals 51, 52 and the brush terminals 55, 56 are press-fitted respectively into the insertion holes 571, 573 of the holder 57. In addition, the choke coils 53, 54 are respectively inserted into the insertion holes 572 of the holder 57. In this insertion, the insertion-side end surfaces of the coils 532, 542 are caused to abut against the coil stoppers 578, and thereafter, the core 541 is pushed to cause the insertion-side end surface of the core 541 to abut against the core stopper 576. Thus, the external connection terminals 51, 52, the choke coils 53, 54, and the brush terminals 55, 56 are mounted to the holder 57.

Thereafter, connection in the following locations is made by thermal crimping or fusing. Specifically, the connecting portions 511, 521 of the external connection terminals 51, 52 and the connecting portions 533, 543 of the choke coils 53, 54 are connected together, connecting portions 534, 544 of the choke coils 53, 54, and connecting portions 551, 561 of the brush terminals 55, 56 are connected together, and the connecting portions 552, 562 of the brush terminals 55, 56 and the pigtails 611, 621 are connected together.

Thus, the assembled body 50K shown in FIGS. 5A, 5B, 5C is constructed.

Subsequently, the portion of the assembled body 50K, other than the bottom surface of the holder 57, the external connection terminals 51, 52, and the connecting portions 552, 562 of the brush terminals 55, 56, is molded with resin. The resin is press-charged into the insertion holes 572 to resin-mold the choke coils 53, 54. Specifically, molten resin is press-charged from the side of the insertion openings 570 into the insertion holes 572, and caused to flow from the through-holes 579 to the outside of the insertion holes 572. Thereby, the resin is press-charged into the clearance defined between the inner peripheral surface 574*a* of the insertion hole 572 and the coil 542 of the choke coil 54. Thus the molded body 50 constructed of the molded portion 50M and the assembled body 50K is formed, as shown in FIGS. 7A to 7D.

Subsequently, the brushes 61, 62 and the brush springs 71, 72 are inserted into the brush holding portion 33 of the bearing holder 30. Thereafter, the molded body 50 is temporarily mounted to the bearing holder 30 in a state in which the brushes 61, 62 and the brush springs 71, 72 are held by press-fitting the recess 57*a* of the molded body 50 onto the projection 37 of the bearing holder 30.

In this temporarily mounted state, the brush springs 71, 72 are resiliently deformed, and the load bearing portion 501 of the molded portion 50M is in contact with the end surfaces of the brush springs 71, 72, and is applied with the resilient force caused by the resilient deformation. However, as described above, the bearing holder 30 and the molded body 50 are press-fitted and fixed together via the projection 37 and the recess 57*a*, so that the molded body 50 can be restricted from floating from the bearing holder 30 due to being applied with the resilient force caused by the resilient deformation.

In a structure where the core stoppers do not exist, when both the choke coils 54 are resin-molded by press-charging resin to both the insertion holes 572, the cores 541 of the choke coils 54 may axially move by being applied with pressure of resin. When the cores 541 axially move, the coils 54 wound around the cores 541 may move together with the cores 541, and consequently, the terminals 55, 56 may be disconnected from the coils 54. By contrast, in the structure of the embodiment, core stoppers 576 axially restrict the cores 541, so that the terminals 55, 56 can be restricted from disconnection from the coils 54.

Thereafter, the discharge-side cover 40 is caused to cover the bearing holder 30 from the upward in FIGS. 2A, 2B, so that the molded body 50 is interposed between the bearing holder 30 and the discharge-side cover 40. Thereby, the molded body 50 is held in a state of being accommodated in the discharge-side cover 40, and the assembled body shown in FIGS. 10A to 10D is constructed.

Thereafter, the fuel pump in a state shown in FIG. 1 is manufactured by inserting the assembled body shown in FIGS. 10A to 10D into the end of the housing 11 opposite to the pump portion 20 and crimping the discharge-side cover 40 to be fixed to the housing 11.

Subsequently, a brief description will be given to an operation of the fuel pump constructed in the manner described above.

The external power source, for example, supplies electricity to the external connection terminals 51, 52, so that the electricity flows through the choke coils 53, 54, the brush terminals 55, 56, the pigtails 611, 621, and the brushes 61, 62 in this order to flow to the segments 151 of the commutator 15. Thereby, the armature 13 rotates, and the impeller 23 rotates together with the shaft 131 of the armature 13.

Consequently, fuel in the unillustrated fuel tank is drawn from the inlet 221 to be raised in pressure by rotation of the impeller 23. The fuel having been raised in pressure is discharged to the space 14 of the motor portion 10 to flow through the fuel passage around the armature 13 in the housing 11, and further flows into the fuel passage 46 (see FIG. 1) located in the discharge-side cover 40 through the through-hole 36.

The clearance 503 defined between the upper surface of the molded portion 50M and the inner surface of the discharge-side cover 40 is communicated to the fuel passage 46 in the discharge-side cover 40, accordingly, the fuel flowing into the fuel passage 46 may enter the clearance 503.

Thereafter, the fuel flowing into the fuel passage 46 in the discharge-side cover 40 upwardly biases the check valve 43 in FIG. 1, thereby being discharged toward an internal combustion engine of a vehicle through the outlet 44 of the fuel discharge portion 41.

As follows, an example structure of a fuel pump is described.

Figure 14:
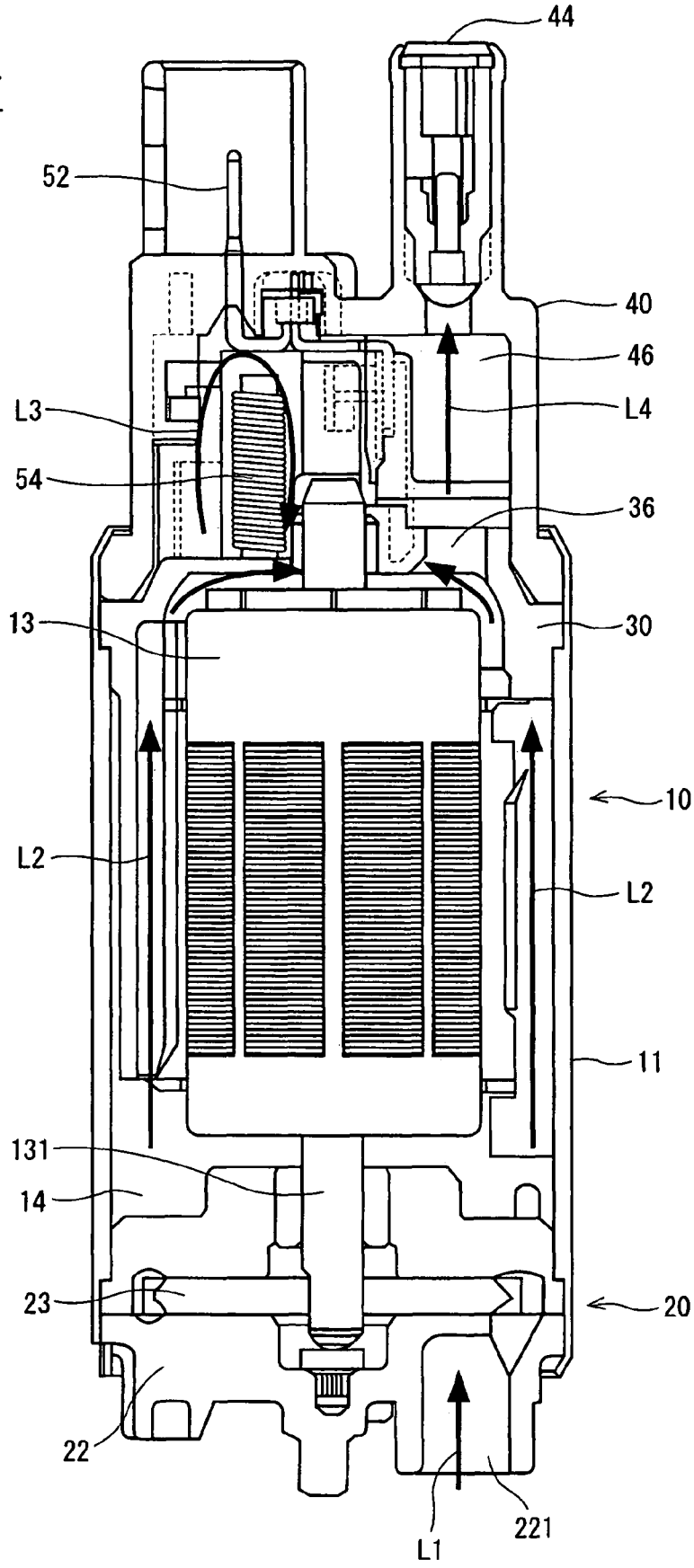
FIG. 14 RELATED ART
FIG. 14 is a view showing a fuel pump according to a related art.
Figure 15:
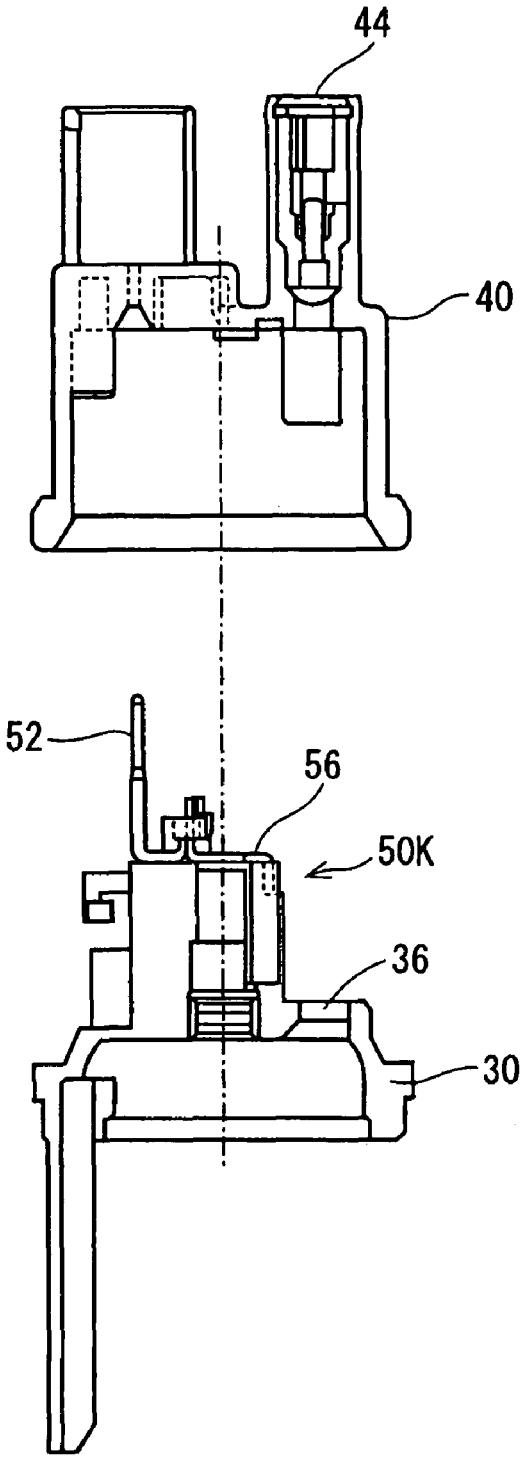
FIG. 15 RELATED ART
FIG. 15 is an exploded view showing a discharge-side cover and a bearing holder of the fuel pump shown in FIG. 14.

As shown in FIGS. 14, 15, a fuel pump includes a discharge-side cover 40, which has an outlet 44 for fuel, and case members 11, 22, which has an inlet 221. The discharge-side cover 40 and the case members 11, 22 define fuel passages 46, 14 therein. The discharge-side cover 40 has a bearing holder 30 being an insulative body. A pump portion 20 constructed of an impeller 23 and the like is driven by a motor portion 10, which is constructed by an armature 13 and the like, and draws fuel from the inlet 221 to pressure feed the fuel toward the outlet 44.

As shown in FIG. 14, a positive electrode terminal 52 and a negative electrode terminal 52 are mounted to the bearing holder 30. The positive and negative electrode terminals 52 are supplied with electric power, which serves as a drive source for the motor portion 10, from an external power source.

Arrows L1 to L4 in FIG. 14 indicate flow of fuel.

When the pump portion 20 is driven, fuel is drawn from the inlet 221 (see the arrow L1) to flow through the fuel passage 14 in the housing 11 (see the arrow L2), and then flows through the fuel passage 46 in the discharge-side cover 40 (see the arrow L3) to be discharged through the outlet 44 (see the arrow L4).

Here, a gasoline-alternate fuel, such as high density alcohol petroleum fuel mixture, bio-ethanol, ethanol 100% fuel, and the like, is in great demand. Since the gasoline-alternate fuel contains a component of high electric conductivity therein, a problem described below is caused when the pump shown in FIGS. 14, 15 are applied to a fuel pump for a gasoline-alternate fuel, as it is.

Specifically, with the fuel pump shown in FIGS. 14, 15, both the terminals 52 respectively have the load bearing portions 56*a* with which resilient forces of the brush springs are applied. Both the terminals 52 are exposed to the fuel passage 46, and consequently, both the terminals 52 are exposed entirely to the gasoline-alternate fuel containing a component of high conductivity (see the arrow L3 in FIG. 14). Consequently, the terminals cause electrochemical corrosion due to exposure to gasoline-alternate fuel, and hence failure of conduction and breakage of the terminals 52 are brought about.

By contrast, in the structure of the embodiment shown in FIGS. 1 to 10C, the upper surface of the molded portion 50M has the projection 502, and the inner surface of the discharge-side cover 40 has the recess 45 being in a shape along the projection surface of the projection 502. In addition, the projection 502 partitions the root portion 512 of the external connection terminal 52 on the positive electrode side from the root portion 512 of the external connection terminal 52 on the negative electrode side. In this structure, a clearance 503 (see FIG. 9A) defined between the upper surface of the molded portion 50M and the inner surface of the discharge-side cover 40 is shaped so as to meander between the projection 502 and the recess 45. Accordingly, a creeping distance between the root portion 512 of the external connection terminal 51 on the positive electrode side and the root portion 512 of the external connection terminal 52 on the negative electrode side becomes large, as compared with the structure where the projection 502 and the recess 45 are not provided. Therefore, it is possible to restrict fuel in the clearance 503 from causing electric corrosion of both the terminals 51, 52.

In the construction of the embodiment, the connector housing 47 has the partition 473 extending in a manner to partition both the external connection terminals 51, 52 from one another. Thereby, the creeping distance between the external connection terminal 51 on the positive electrode side and the external connection terminal 52 on the negative electrode side becomes large in the connector housing 47, as compared with the structure where the partition 473 is not provided. Therefore, fuel entering the connector housing 47 can be restricted from causing electric corrosion of both the terminals 51, 52.

Second Embodiment

The fuel pump according to the second embodiment is described with reference to FIGS. 11 to 13D.

Figure 12A:
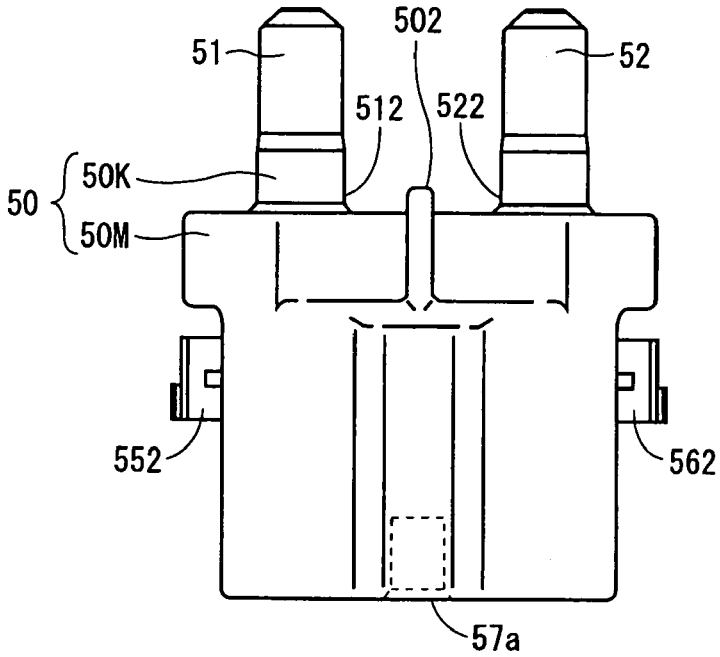
FIG. 12A is a front view showing the molded body.
Figure 12B:
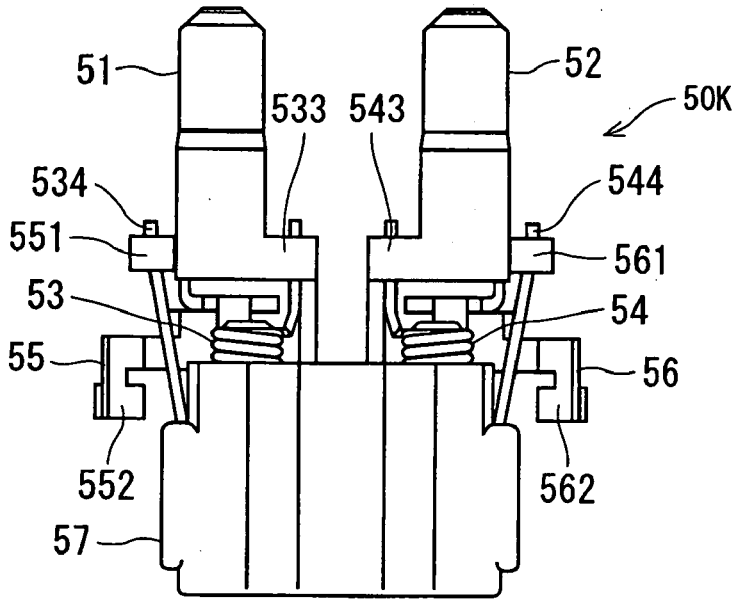
FIG. 12B is a front view showing the assembled body, according to the second embodiment.
Figure 13D:
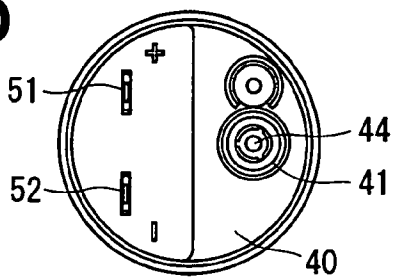
FIGS. 13A to 13D compose a tetrahedral view, FIG. 13A being a front view, FIG. 13B being a side view, FIG. 13C being a rear view, and FIG. 13D being a plan view, each showing a state in which the discharge-side cover is mounted to the bearing holder, according to the second embodiment.
Figure 13B:
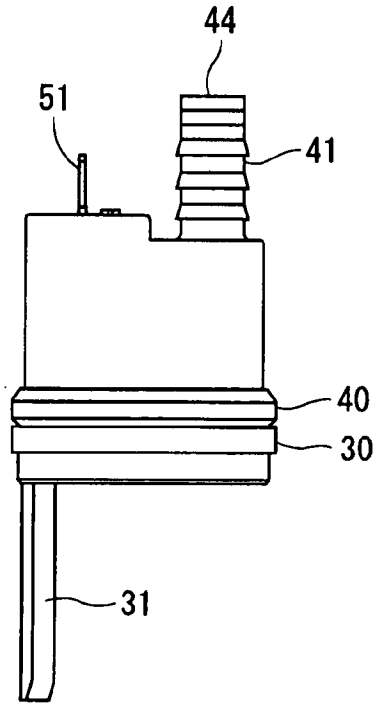
Figure 13C:
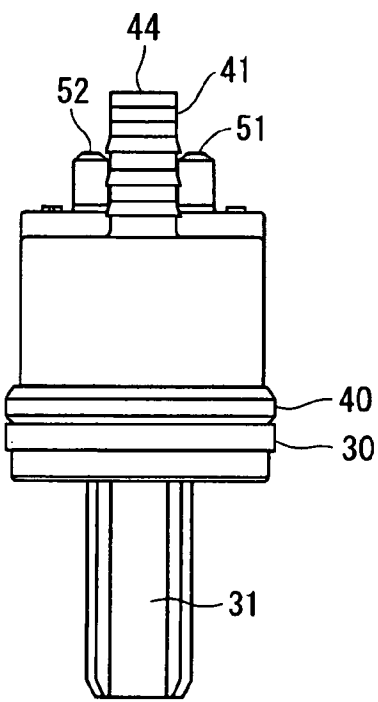
Figure 13A:
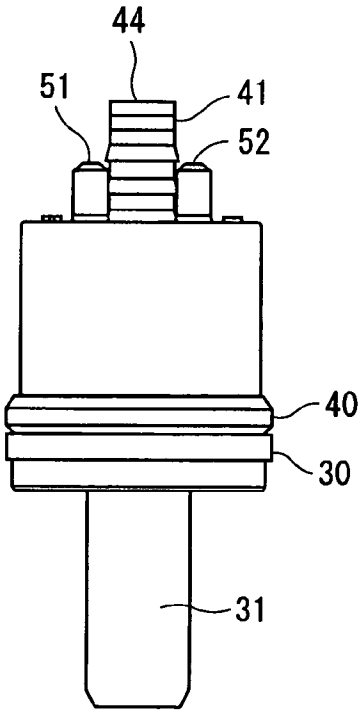

As shown in FIGS. 12A, 12B, the molded body 50 is constructed of a molded portion 50M and an assembled body 50K, similarly to the first embodiment. In this embodiment, the discharge-side cover 40 may not provided with a connector housing 47 (FIG. 1).

In this structure of the embodiment, the external connection terminal 51 on the positive electrode side and the external connection terminal 52 on the negative electrode side are also mounted to a holder 57 of an insulative body, and are also resin-molded. Therefore, it is also possible to decrease areas, via which the external connection terminals 51, 52, the choke coils 53, 54, and the brush terminals 55, 56 are exposed to the fuel passage 46, as compared with the conventional construction, in which the external connection terminals 51, 52, the choke coils 53, 54, and the brush terminals 55, 56 are only mounted to the holder 57 and are not resin-molded. Accordingly, even in the case where a gasoline-alternate fuel containing a component of high electric conductivity therein is used in the fuel pump, it is possible to suppress electric corrosion of both the external connection terminals 51, 52 and to decrease a fear of failure of conduction and breakage of both the external connection terminals 51, 52.

Other Embodiments

According to the embodiment, the projection 502 is provided on the molded body 50 and the recess 45 is provided on the discharge-side cover 40. Alternatively, the molded body 50 may be made partially concave and the discharge-side cover 40 may be partially made projection.

According to the embodiment, the projection 37 is provided on the bearing holder 30 and the recess 57*a* is provided on the holder 57. Alternatively, the bearing holder 30 may be made partially concave and the holder 57 may be partially made projection.

According to the embodiment, the holder 57 and the molded portion 50M are separately resin-molded, and the holder 57 and the molded portion 50M construct the terminal support member. Alternatively, the holder 57 and the molded portion 50M may be integrally resin-molded.

That is, for example, the holder 57 may be omitted, and a terminal support member having both the outline shape of the molded body 50 and the outline shape of the holder 57 shown in FIGS. 7A to 7D, may be formed.

In addition, for example, the molded portion 50M may be omitted, and a terminal support member may have both an outline shape of the molded body 50 and an outline shape of the holder 57 shown in FIGS. 7A to 7D.

According to the embodiment, a terminal support member, which is constructed by the holder 57 and the molded portion 50M, and the bearing holder 30 are separately resin-molded. Alternatively, the terminal support member and the bearing holder 30 may be integrally resin-molded.

According to the embodiment, the external connection terminals 51, 52, the choke coils 53, 54, the brush terminals 55, 56, and the holder 57 are resin-molded. Alternatively, it suffices that at least the external connection terminals 51, 52 are resin-molded. In addition, for example, the external connection terminals 51, 52 may be resin-molded together with at least one of the choke coils 53, 54, the brush terminals 55, 56, and the holder 57.

According to the embodiment, fuel used in the fuel pump is one containing a component of high electric conductivity. Alternatively, fuel used in the fuel pump may be an ordinary gasoline.

The connector housing 47 may be provided to the fuel pump of the second embodiment.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel pump comprising:

a discharge-side cover defining an outlet;

a case member connected with the discharge-side cover, and defining a fuel passage communicating with the outlet, the case member defining an inlet;

a pump portion provided in the fuel passage for pumping fuel from the inlet to the outlet;

a motor portion provided in the case member for driving the pump portion;

a positive electrode terminal and a negative electrode terminal each extending from an inside of the discharge-side cover for conducting electricity to the motor portion;

a bearing holder being insulative and supporting a rotation axis of the motor portion; and a terminal support member being insulative and provided between the discharge-side cover and the bearing holder for supporting the positive electrode terminal and the negative electrode terminal, wherein the terminal support member has a projection projecting from a portion between the positive electrode terminal and the negative electrode terminal, said projection being spaced from each of the positive electrode terminal and the negative electrode terminal, the discharge-side cover has a recess receiving the projection, and said projection extends in a direction perpendicular to an extension direction in which the positive electrode terminal and the negative electrode terminal extend, and perpendicular to a line extending between the positive electrode terminal and the negative electrode terminal, to extend across a space between the positive electrode terminal and the negative electrode terminal.

2. The fuel pump according to claim 1, wherein the terminal support member is resin-molded separately from the bearing holder and the discharge-side cover, and the terminal support member is supported by being interposed between the discharge-side cover and the bearing holder.

3. The fuel pump according to claim 2, wherein the terminal support member includes a holder being insulative and mounted with the positive electrode terminal and the negative electrode terminal, the terminal support member further includes a molded portion being resin-molded with at least the positive electrode terminal and the negative electrode terminal, and the molded portion includes one of the projection and the recess.

4. The fuel pump according to claim 1, wherein the discharge-side cover has a connector housing accommodating the positive electrode terminal and the negative electrode terminal, and the connector housing has a partition to separate a space, which accommodates the positive electrode terminal, from a space, which accommodates the negative electrode terminal.

5. The fuel pump according to claim 1, wherein the recess is in a shape along a surface defining the projection.

6. The fuel pump according to claim 5, wherein the recess and the projection therebetween define a clearance that is shaped so as to meander.

7. A fuel pump comprising:

a case member defining a fuel passage, an inlet, and an outlet;

a pump portion provided in the fuel passage for pumping fuel from the inlet to the outlet;

a motor portion provided in the case member for driving the pump portion;

a positive electrode terminal and a negative electrode terminal for conducting electricity to the motor portion;

a discharge-side cover defining an outlet communicating with the fuel passage;

a bearing holder being insulative and supporting a rotation axis of the motor portion; and a terminal holder being insulative and provided inside the case member, axially between the discharge-side cover and the bearing holder, wherein the terminal holder is mounted with the positive electrode terminal and the negative electrode terminal, whereby the electrode terminals are protected from electric corrosion due to exposure to fuel, the positive electrode terminal and the negative electrode terminal are resin-molded, the positive electrode terminal and the negative electrode terminal respectively extend from an inside of the discharge-side cover for conducting electricity to the motor portion, the terminal holder has a projection projecting from a portion between the positive electrode terminal and the negative electrode terminal, said projection being spaced from each of the positive electrode terminal and the negative electrode terminal, the discharge-side cover has a recess receiving the projection, and said projection extends in a direction perpendicular to an extension direction in which the positive electrode terminal and the negative electrode terminal extend, and perpendicular to a line extending between the positive electrode terminal and the negative electrode terminal, to extend across a space between the positive electrode terminal and the negative electrode terminal.

8. The fuel pump according to claim 7, wherein the motor portion includes:

an armature for driving the pump portion;

a commutator for rectifying electricity supplied to the armature;

brushes slidable on the commutator to conduct electricity respectively from the positive electrode terminal and the negative electrode terminal to the commutator; and a positive-electrode choke coil and a negative-electrode choke coil for reducing electric noise caused by sliding of the brushes on the commutator, wherein the positive-electrode choke coil and the negative-electrode choke coil are mounted to the terminal holder, and the positive-electrode choke coil and the negative-electrode choke coil are resin-molded together with the positive electrode terminal and the negative electrode terminal.

9. The fuel pump according to claim 8, wherein the positive-electrode choke coil includes a positive-electrode core, and further includes a positive-electrode coil being wound around the positive-electrode core and connected with the positive electrode terminal, the negative-electrode choke coil includes a negative-electrode core, and further includes a negative-electrode coil being wound around the negative-electrode core and connected with the negative electrode terminal, the terminal holder defines a positive-electrode insertion hole inserted with the positive-electrode choke coil with respect to an axial direction of the positive-electrode core, the terminal holder further defines a negative-electrode insertion hole inserted with the negative-electrode choke coil with respect to an axial direction of the negative-electrode core, the positive-electrode choke coil is resin-molded by press-charging resin to the positive-electrode insertion hole, and the negative-electrode choke coil is resin-molded by press-charging resin to the negative-electrode insertion hole.

10. The fuel pump according to claim 9, wherein the terminal holder has core stoppers respectively in the positive-electrode insertion hole and the negative-electrode insertion hole for respectively latching to axially restrict insertion-side end surfaces of both the positive-electrode core and the negative-electrode core.

11. The fuel pump according to claim 9, wherein the terminal holder has coil stoppers respectively in the positive-electrode insertion hole and the negative-electrode insertion hole for respectively latching to axially restrict insertion-side end surfaces of both the positive-electrode choke coil and the negative-electrode choke coil.

12. The fuel pump according to claim 9, the terminal holder defines insertion openings, through which both the positive-electrode choke coil and the negative-electrode choke coil are respectively inserted into the positive-electrode insertion hole and the negative-electrode insertion hole, and the terminal holder further defines through-holes on opposite sides to the insertion openings to respectively communicate between an inside and an outside of the positive-electrode insertion hole and the negative-electrode insertion hole.

13. The fuel pump according to claim 7, wherein the terminal holder is resin-molded separately from the bearing holder and the discharge-side cover, and the terminal holder is supported by being interposed axially between the discharge-side cover and the bearing holder.

14. The fuel pump according to claim 7, wherein the discharge-side cover has a connector housing accommodating the positive electrode terminal and the negative electrode terminal, and the connector housing has a partition to separate a space, which accommodates the positive electrode terminal, from a space, which accommodates the negative electrode terminal.

15. The fuel pump according to claim 1, wherein the terminal support member is a separate component from the discharge-side cover and the bearing holder and fixed to the discharge-side cover and the bearing holder.

16. The fuel pump according to claim 15, wherein the terminal support member includes a molded portion, which is formed by resin molding to cover the positive electrode terminal and the negative electrode terminal.

17. The fuel pump according to claim 16, wherein the molded portion isolates the positive electrode terminal and the negative electrode terminal from the fuel passage.

18. The fuel pump according to claim 17, wherein the recess is fitted to the projection.

19. The fuel pump according to claim 7, wherein the terminal holder is a separate component from the discharge-side cover and the bearing holder and fixed to the discharge-side cover and the bearing holder.

20. The fuel pump according to claim 19, wherein the terminal holder includes a molded portion, which is formed by resin molding to cover the positive electrode terminal and the negative electrode terminal.

21. The fuel pump according to claim 20, wherein the molded portion isolates the positive electrode terminal and the negative electrode terminal from the fuel passage.

22. The fuel pump according to claim 21, wherein the recess is fitted to the projection.

23. The fuel pump according to claim 1, wherein:

the projection partitions a root portion of the positive electrode terminal from a root portion of the negative electrode terminal on a side of the holder, and the recess is shaped to correspond to a surface of the projection.

24. The fuel pump according to claim 23, wherein a surface of the terminal support member defines the projection, whereby said surface defines a distance between the root portion of the positive electrode terminal and the root portion of the negative electrode terminal that is greater than a linear distance between the root portion of the positive electrode terminal and the root portion of the negative electrode terminal.

25. The fuel pump according to claim 7, wherein:

the projection partitions a root portion of the positive electrode terminal from a root portion of the negative electrode terminal on a side of the holder, and the recess is shaped to correspond to a surface of the projection.

26. The fuel pump according to claim 25, wherein a surface of the terminal support member defines the projection, whereby said surface defines a distance between the root portion of the positive electrode terminal and the root portion of the negative electrode terminal that is greater than a linear distance between the root portion of the positive electrode terminal and the root portion of the negative electrode terminal.

* * * * *